US011377869B2

(12) United States Patent
Yang

(10) Patent No.: US 11,377,869 B2
(45) Date of Patent: Jul. 5, 2022

(54) TENT AND SUPPORT DEVICE THEREFOR

(71) Applicant: Zhejiang Hengfeng Top Leisure Co., Ltd., Zhejiang (CN)

(72) Inventor: Baoqing Yang, HangZhou (CN)

(73) Assignee: ZHEJIANG HENGFENG TOP LEISURE CO., LTD, Zhejiang (CN)

( * ) Notice: Subject to any disclaimer, the term of this patent is extended or adjusted under 35 U.S.C. 154(b) by 32 days.

(21) Appl. No.: 17/136,336

(22) Filed: Dec. 29, 2020

(65) Prior Publication Data

US 2021/0198918 A1 Jul. 1, 2021

(30) Foreign Application Priority Data

Dec. 31, 2019 (CN) ..... 201922497866.9

(51) Int. Cl.
*E04H 15/46* (2006.01)
*E04H 15/64* (2006.01)

(52) U.S. Cl.
CPC ..... *E04H 15/46* (2013.01); *E04H 15/64* (2013.01)

(58) Field of Classification Search
None
See application file for complete search history.

(56) References Cited

U.S. PATENT DOCUMENTS 1,090,738 A * 3/1914 McDonald ..... E04H 15/60 135/114
3,371,671 A * 3/1968 Kirkham ..... E04H 15/44 135/156
4,066,089 A * 1/1978 Rainwater ..... E04H 15/48 135/117
5,577,799 A * 11/1996 St. Germain ..... A47C 5/06 297/53
6,089,247 A * 7/2000 Price ..... E04H 15/48 135/145
6,216,717 B1 * 4/2001 Chen ..... E04H 15/44 135/130
6,666,223 B2 * 12/2003 Price ..... E04H 15/50 135/147
7,357,140 B2 * 4/2008 Chu ..... E04H 15/48 135/144
7,753,064 B2 * 7/2010 Sy-Facunda ..... E05C 3/14 135/145

(Continued)

FOREIGN PATENT DOCUMENTS

KR 20160113752 A * 10/2016

*Primary Examiner* — David R Dunn
*Assistant Examiner* — Danielle Jackson
(74) *Attorney, Agent, or Firm* — Thompson Coburn LLP

(57) ABSTRACT

A tent surface support device includes a support skeleton. The support skeleton is provided with a top rod that includes a middle top rod arranged in the middle of the top rod. The middle top rod is divided into a first portion and a second portion which are bendable toward each other. A connecting member is hinged between the first portion and the second portion, and a locking assembly configured to lock the two portions in an unbent state is provided between the first portion and the second portion. When tent is first set-up, the support skeleton is nested into the tent surface, and the first portion and the second portion of the middle top rod are bent. Then, the first and second portions of the middle top rod may be locked together to allow erection of the tent.

12 Claims, 4 Drawing Sheets

(56) References Cited

U.S. PATENT DOCUMENTS 7,775,229 B2 * 8/2010 Sy-Facunda ..... E04H 15/50
135/117
8,746,267 B2 * 6/2014 Lovley, II ..... E04H 15/50
135/120.2

* cited by examiner

TENT AND SUPPORT DEVICE THEREFOR

RELATED APPLICATION DATA

This application claims the benefit of Chinese Utility Model Application Ser. No. CN 201922497866.9, filed on Dec. 31, 2019, published as CN 211818487 U on Oct. 30, 2020, the disclosure of which is incorporated by reference herein.

BACKGROUND

The present application relates to the field of tents and support devices for tents.

During the unfolding and erection of a tent, it is generally necessary to support the tent with a skeleton that cooperates with flaps and sleeves formed on the surface of the tent material.

In the prior art, an I-shaped skeleton is commonly used. The I-shaped skeleton includes a top rod and two side rods. In conventional I-shaped skeletons, the top rod and the two side rods are composed of multiple short rods that may be connected together by nesting the shorts rods. Commonly, each of the short rods is frangibly connected to each other with an elastic rope on the inside of each elastic short rod. When the skeleton is disassembled, the short rods are separated, and when the skeleton is assembled, the short rods are connected by insertion and nesting.

However, in the prior art, there is no difference in length between the top rod and the tent material forming the surface of the tent. Because the lengths are substantially the same, it is difficult to insert the side rods on two sides of the I-shaped skeleton into the tent. The conventional installation is inconvenient, and the skeleton or the tent surface is prone to being torn.

Therefore, a technical issue to be addressed presently by those skilled in the art is to improve the convenience of use of the skeleton. The disclosure accomplishes this with a tent surface quick support device.

SUMMARY

An object of the present application is to provide a tent surface quick support device. With the tent surface quick support device, it is convenient to install side rods, and quick support for the tent surface can be realized by providing snap-in assemblies and by the bending of the top rod. Another object of the present application is to provide a tent including the above tent surface quick support device.

As described below in more detail, a tent surface quick support device includes a support skeleton. The support skeleton is provided with a top rod. The top rod includes a middle top rod arranged in the middle of the top rod. The middle top rod has a first portion and a second portion which are bendable toward each other. A connecting member is hingedly connected with the first portion and the second portion. A locking assembly provided between the first portion and the second portion is configured to lock the first and second portions in an unbent state.

Preferably, the locking assembly includes a hinge member fixed on one of the first portion and the second portion, a rotating rod hinged to the hinge member, and a locking member sleeved on the other portion of the first portion and the second portion, where the locking member is able to be sleeved onto the rotating rod after sliding.

Preferably, the hinge member is U-shaped with an upward opening, the bottom of the hinge member is fixed on the first portion or the second portion, an end portion of the rotating rod is hinged to the open end of the hinge member, and the rotating rod is able to swing along a vertical plane.

Preferably, the first portion or the second portion, where the locking member is installed, is provided with a retainer that holds the locking member in position on the other of the first and second portions during the initial stages of the assembly. Then when the first and second portions are aligned in parallel (preferably coaxially), the locking member may be disengages from the retainer, preferably rotated into position and slid onto the rotating rod to engage the locking assembly. The retainer may be an elastic boss on the locking member that engages with a snap-in hole provided on the other of the first and second portion of the middle top rod. The elastic boss is configured to engage with the snap-in hole to prevent the locking member from sliding on the other of the first and second portion when the locking member is in an unlocked state.

Preferably, the support skeleton further includes side rods arranged on the left and right sides of the top rod, and the side rods extend along a horizontal plane.

Preferably, the support skeleton further includes side foot rods arranged on the left and right sides of the top rod, and the side foot rods extend along a vertical plane.

Preferably, both the side rods and the side foot rods include multiple elastic pluggable short rods or multiple elastic telescopic rods.

Preferably, the top rod further includes a left top rod and a right top rod respectively arranged on two sides of the middle top rod, and both the left top rod and the right top rod include multiple elastic pluggable short rods or multiple elastic telescopic rods.

Preferably, the connecting member is U-shaped with a downward opening, the connecting member extends in a transverse direction, the first portion and the second portion are respectively hinged to the middle of the connecting member, a rotation gap is provided between the first portion and the second portion, and the top of the connecting member is able to restrict the first portion and the second portion from rotating upward.

A tent is further provided according to the present application, which includes the tent surface quick support device according to any one of the above aspects.

The tent surface quick support device according to the present application includes the support skeleton. The support skeleton is provided with the top rod. The top rod includes the middle top rod arranged in the middle of the top rod. The middle top rod is divided into the first portion and the second portion which are bendable toward each other, and the connecting member is hinged between the first portion and the second portion. The locking assembly, which is configured to lock the two portions in an unbent state, is provided between the first portion and the second portion. In the tent surface quick support device according to the present application, the middle top rod is divided into two portions, and the connecting member and the locking assembly are provided between the two portions. When the support skeleton is nested into the tent surface, the first portion and the second portion of the middle top rod are bent, so that the top rod is arched, and the length of the support skeleton and the length of the tent surface have a large difference. Therefore, it is easy to press down the connecting member after the support skeleton is nested into and connected with the tent surface, and it is easy to position and lock the middle top rod by the locking assembly, so that the first portion and the second portion form a solid link.

After the support skeleton is assembled, the support for the tent body is finished by connecting the side rods of the tent body.

The tent according to the present application is provided with the above-mentioned tent surface quick support device. Since the tent surface quick support device has the above technical effects, the tent provided with the tent surface quick support device also has corresponding technical effects.

BRIEF DESCRIPTION OF THE DRAWINGS

For more clearly illustrating embodiments of the present application or the technical solutions in the conventional technology, drawings referred to for describing the embodiments or the conventional technology will be briefly described hereinafter.

FIG. 3-1 is a structural view of the first installation step of the tent surface quick support device according to the present application;

FIG. 3-2 is a structural view of the second installation step of the tent surface quick support device according to the present application;

FIG. 3-3 is a structural view of the third installation step of the tent surface quick support device according to the present application;

FIG. 3-4 is a structural view of the fourth installation step of the tent surface quick support device according to the present application; and FIG. 4 is a structural view of the tent surface quick support device in actual dimension ratio according to the present application.

DETAIL DESCRIPTION OF THE EMBODIMENTS

As will become evident from the discussion that follows below, there is the provision of a tent T and a tent surface TS quick support device, which are convenient to use, efficient in assembly, easy to manufacture, and low in cost. In one embodiment, the tent surface quick support device includes a support skeleton, where the support skeleton is provided with a top rod 1. The top rod 1 includes a middle top rod 1-2 arranged in the middle of the top rod 1. The middle top rod 1-2 is divided into a first portion 1-2-1 and a second portion 1-2-2, and a connecting member 5 is hinged between the first portion 1-2-1 and the second portion 1-2-2. Both the first portion 1-2-1 and the second portion 1-2-2 are rotatable relative to the connecting member 5.

Figure 1:
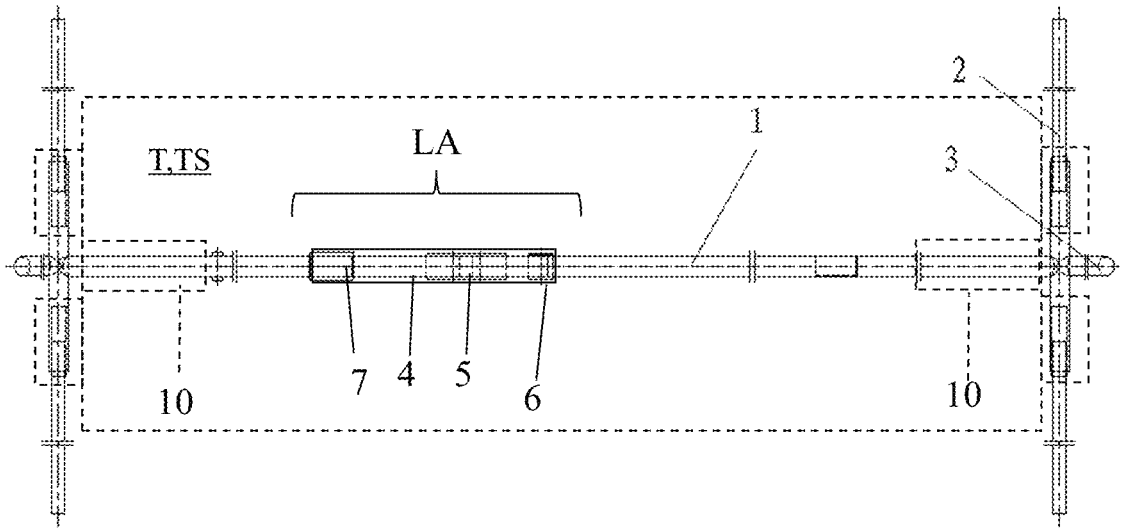
FIG. 1 is a top view of a specific embodiment of a tent surface quick support device according to the present application.

Specifically, the connecting member 5 is a two way connector with preferably a U-shaped structure with a downward opening. The connecting member 5 extends in a transverse direction. The first portion 1-2-1 and the second portion 1-2-2 are respectively hinged to the middle of the connecting member 5. A rotation gap G (see, FIG. 3-1) is provided between the first portion 1-2-1 and the second portion 1-2-2. The top of the U-shaped structure of the connecting member 5 with the downward opening is able to restrict the first portion 1-2-1 and the second portion 1-2-2 from rotating upward, which prevents the first portion 1-2-1 and the second portion 1-2-2 from bending reversely when the top rod 1 is pressed down. The connecting member may be configured to align each of the first and second portions of the middle top rod with the connecting member. As shown in the drawings, the connecting member aligns the first and second portions 1-2-1,1-2-2 in a straight line or coaxially. The connecting member may also align the first and second portions offset in a parallel relationship or in an angular relationship.

Further, a locking assembly (FIG. 1, LA) that is configured to lock the two portions in an unbent state is provided between the first portion 1-2-1 and the second portion 1-2-2. The locking assembly LA is able to realize quick locking of the middle top rod 1-2.

Figure 2:
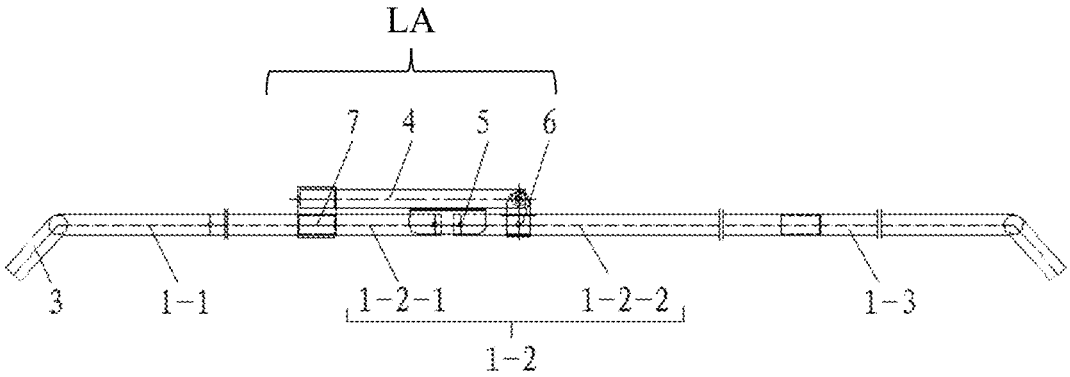
FIG. 2 is a front view of a specific embodiment of the tent surface quick support device according to the present application.
Figures 1, 3:
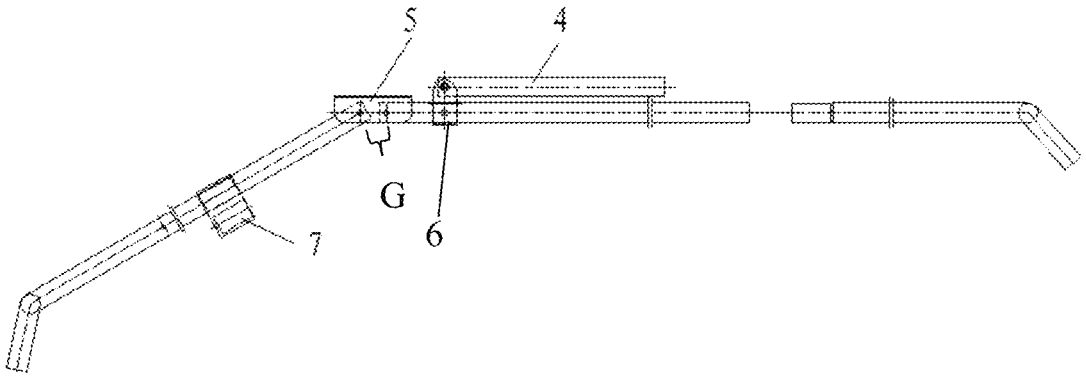
Figures 2, 3:
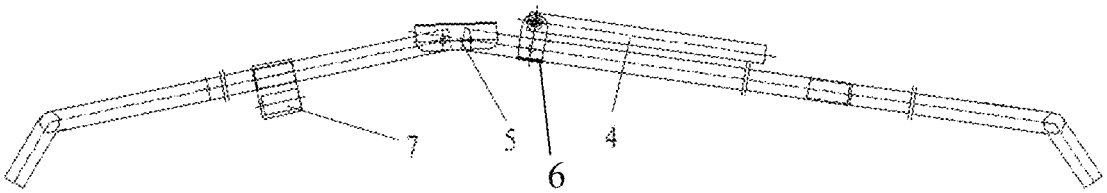
Figures 3, 4:
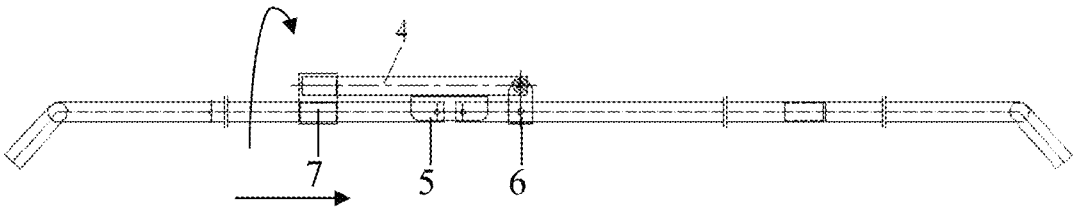
Figure 3:
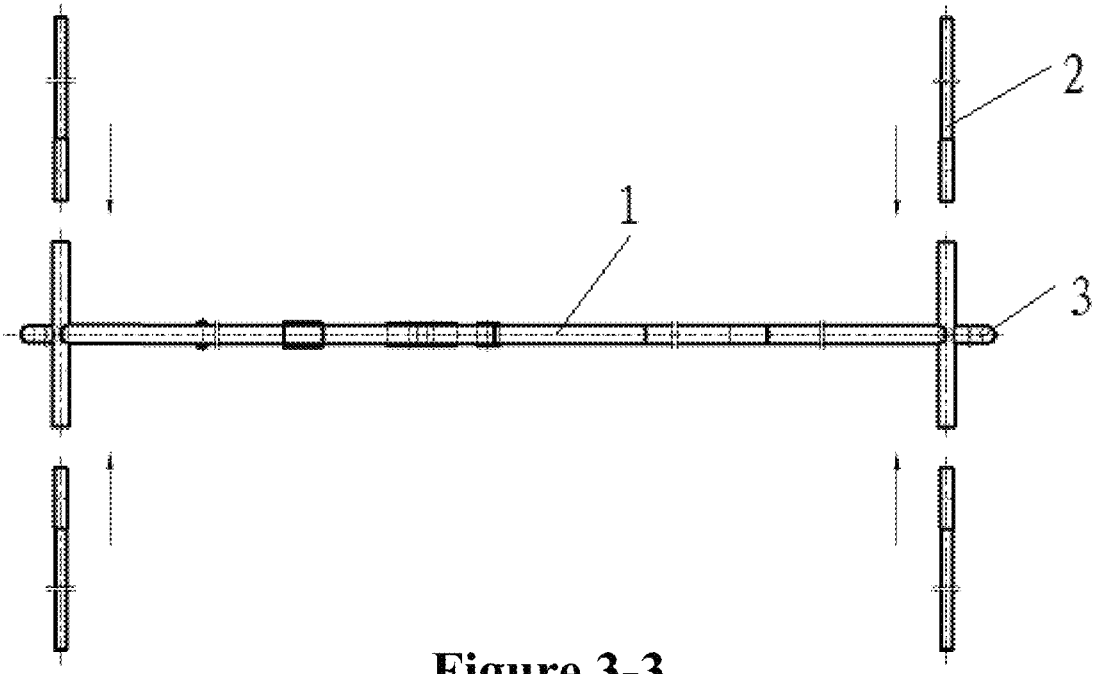
Figure 4:
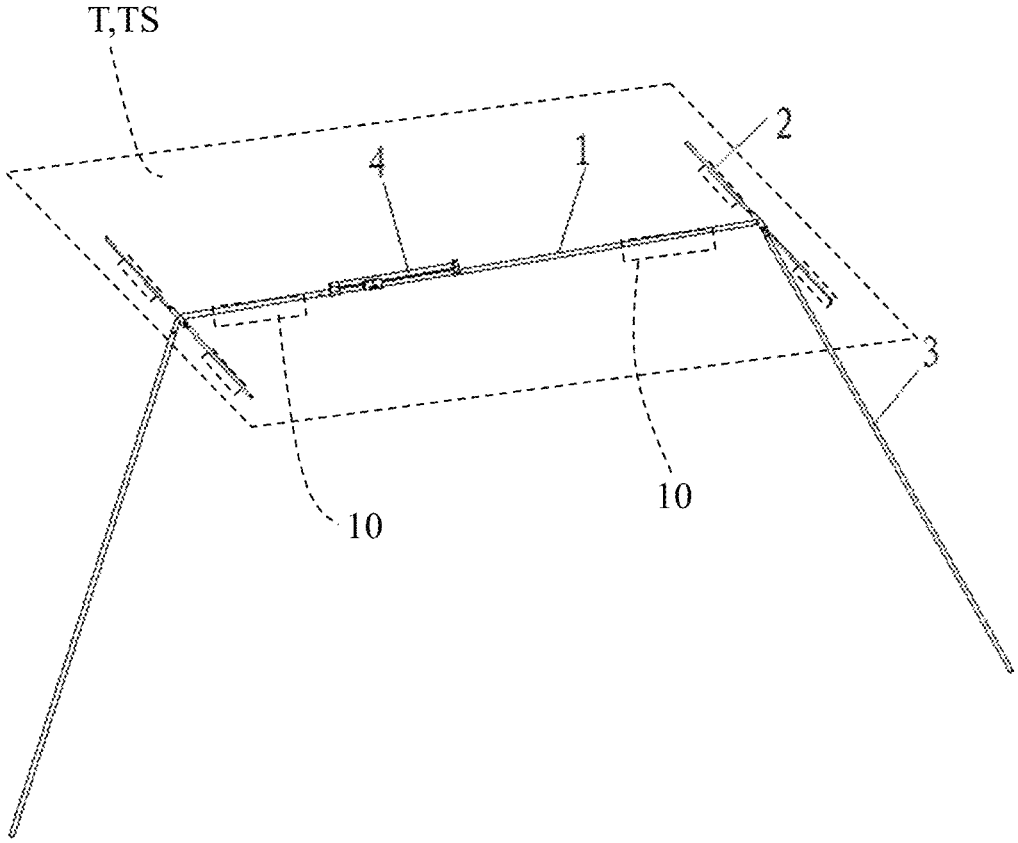

In the tent surface quick support device according to the present application, the middle top rod 1-2 is divided into the two portions 1-2-1 and 1-2-2, and the connecting member 5 and the locking assembly LA are provided between the two portions. When the support skeleton is nested into the tent surface, for instance, through sleeves 10 (FIGS. 1,4) formed in the tent surface TS or flaps extending from the tent surface that may be formed into sleeves 10, the first portion 1-2-1 and the second portion 1-2-2 of the middle top rod 1-2 are bent (that is, pivoted about their respective hinge connections with the connecting member 5), so that the top rod 1 is arched, for instance as shown in FIG. 3-2, and the length of the support skeleton and the length of the tent surface have a large difference. This allows easy assembly so the top rod 1 may be assembled with the tent surface without a significant amount of tension in the tent surface or top rod. After the support skeleton is nested into and connected with the tent surface TS, it is easy to press down the connecting member 5, and position and lock the middle top rod 1-2 with the locking assembly, so that the first portion 1-2-1 and the second portion 1-2-2 form a straight linkage through the connecting member 5, for instance, as shown in FIG. 3-4. After the support skeleton is assembled, the support for the tent body is finished by connecting the side rods 2 of the tent body.

The locking assembly LA may include a hinge member 6 fixed on one of the first portion 1-2-1 and the second portion 1-2-2, a rotating rod 4 hinged to the hinge member 6, and a locking member 7 sleeved on the other portion of the first portion and the second portion. The locking member 7 is able to be slid and sleeved onto the rotating rod 4 to lock the first and second portions 1-2-1,1-2-2 of the middle top rod together. In the above arrangement, one side of the locking member is sleeved on the first portion 1-2-1 or the second portion 1-2-2, and another side of the locking member has a blind hole into which an end portion of the rotating rod 4 is inserted.

The hinge member 6 may be U-shaped with an upward opening. The bottom of the hinge member 6 may be fixed on the first portion 1-2-1 or the second portion 1-2-2, as applicable. The end portion of the rotating rod 4 may be hinged to the open end of the hinge member 6. The rotating rod 4 is able to swing along a vertical plane. The middle top rod 1-2 can be locked by rotating the rotating rod 4 to a position where the rotating rod 4 spans over the connecting member 5 and holds the connecting member down thereby maintaining the first and second portions in straight parallel or coaxially alignment.

Further, the first portion 1-2-1 or the second portion 1-2-2 where the locking member 7 is installed may be provided with retainer to maintain the locking member in position on the applicable first or second portion in the unlocked state. With the retainer, the locking member may be in a stationary position away from the connecting member 5 until the first and second portions 1-2-1,1-2-2 are arranged in position to be locked. Then the locking member may be disengaged from the retainer, rotated on the applicable first and second portion, and slid into position to engage the rotating rod 4 (see arrows in FIG. 3-4) In one example, the retainer may comprise a snap-in hole on the applicable first and second portion, and the locking member 7 may be provided with an elastic boss. The elastic boss is able to engage with the snap-in hole to prevent the locking member 7 from slipping off or along the applicable first and second portion in an unlocked state. Preferably, the elastic boss is an arc-shaped boss or a spherical boss, which facilitates the movement of the locking member 7.

The support skeleton may further include side rods 2 located on the left and right sides of the top rod 1. The side rods 2 may extend along a horizontal plane. Preferably, two side rods 2 are provided, which are respectively located on the left and right sides of the top rod 1. From the top view of the support skeleton, the support skeleton is I-shaped, and has a large support area for the tent surface.

The support skeleton may further include side foot rods 3 located on the left and right sides of the top rod 1, the side foot rods 3 extend along a vertical plane. Preferably, two side foot rods 3 are provided, which are respectively located on the left and right sides of the top rod 1. Both the side rods 2 and the side foot rods 3 may include multiple elastic pluggable short rods or multiple elastic telescopic rods, as shown in FIG. 4.

The top rod 1 may further include a left top rod 1-1 and a right top rod 1-3 which are respectively located on two sides of the middle top rod 1-2. Both the left top rod 1-1 and the right top rod 1-3 include multiple elastic pluggable short rods or multiple elastic telescopic rods, that is, from the left to the right are the left top rod 1-1, the middle top rod 1-2 and the right top rod 1-3 of the top rod 1. The entire support skeleton can be easily installed through the division, bending and locking of the middle top rod 1-2, so as to quickly prop up and erect the tent.

In addition to the aforementioned tent surface quick support device, a tent T including the aforementioned tent surface quick support device is further provided according to the present application. Reference may be made to the conventional technology for other structures of the tent, which will not be described herein.

The principle and the embodiments described above are illustrated herein by specific examples only for the purpose of facilitating an understanding of the method and concept of the embodiments of the present application. It should be noted that, for those skilled in the art, various improvements and modifications may be made to the present application without departing from the principle of the present application, and these improvements and modifications are also deemed to fall into the protection scope of the present application defined by the claims.

The invention claimed is:

1. A support device for a tent, the support device being arranged adjacent to a surface of the tent when the support device is assembled with the tent, the support device comprising a support skeleton, the support skeleton comprising a top rod, the top rod comprising a middle top rod arranged in a middle region of the top rod, the middle top rod having a first portion and a second portion, the first portion and second portion each being hingedly connected to a connecting member such that the first portion and the second portion are pivotable relative to the connecting member between an bent state where the first and second portions are pivotable toward and away each other and an unbent state where the first and second portions are aligned with the connecting member, the middle top rod further having a locking assembly configured to lock the first and second portions when the first and second portion are in the unbent state to maintain the first and second portions aligned with the connecting member, and to unlock the first and second portions to allow the first and second portions to be moved to the bent state;

wherein the locking assembly comprises a hinge member fixed on one of the first portion and the second portion, a rotating rod hinged to the hinge member, and a locking member sleeved on the other of the first portion and the second portion, the locking member being movable on the other of the first portion and the second portion to engage the rotating rod to lock the first and second portions together when the first and second portion are in the unbent state and to disengage the rotating rod to unlock the first and second portions to allow the first and second portions to be moved to the bent state.

2. The support device according to claim 1, wherein the hinge member has an upward open end and a bottom, the bottom of the hinge member is fixed on the one of the first portion and the second portion, the open end of the hinge is hingedly connected to an end portion of the rotating rod in a manner that the rotating rod is able to swing along a vertical plane.

3. The support device according to claim 1, wherein the locking member is rotatable on the other of the first portion and the second portion.

4. The support device according to claim 1, wherein the locking member is translatable on the other of the first portion and the second portion.

5. The support device according to claim 1, wherein the support skeleton further comprises side rods arranged on left and right sides of the top rod, the side rods extending along a horizontal plane when the support skeleton is erected on a support surface.

6. The support device according to claim 5, wherein the support skeleton further comprises side foot rods arranged on the left and right sides of the top rod, the side foot rods extending along a vertical plane when the support skeleton is erected on a support surface.

7. The support device according to claim 6, wherein both the side rods and the side foot rods comprise at least one of a plurality of elastic pluggable short rods and elastic telescopic rods.

8. The support device according to claim 1, wherein the top rod comprises a plurality of members with the middle top rod as one in the plurality of members.

9. The support device according to claim 1 wherein the middle top rod is separatable from top rod.

10. The support device according to claim 1, wherein the top rod comprises a left top rod and a right top rod respectively arranged on opposite ends of the middle top rod, the left top rod and the right top rod comprising at least one of a plurality of elastic pluggable short rods and elastic telescopic rods.

11. The support device according to claim 1, wherein the connecting member is U-shaped with a downward opening, the first and the second portion of the middle top rod are respectively hinged to a middle of the connecting member, a rotation gap is provided between the first portion and the second portion, and a top of the connecting member is configured to restrict the first portion and the second portion from rotating upward.

12. A tent comprising the support device according to claim 1.

* * * * *